United States Patent [19]

Tischhauser et al.

[11] Patent Number: 4,700,027

[45] Date of Patent: Oct. 13, 1987

[54] SWITCH ACTUATOR SYSTEM

[75] Inventors: Thomas J. Tischhauser, Hoffman Estates; Harold G. Hanley, Arlington Heights, both of Ill.

[73] Assignee: Motorola, Inc., Schaumburg, Ill.

[21] Appl. No.: 897,959

[22] Filed: Aug. 19, 1986

[51] Int. Cl.[4] ..... H01H 13/06

[52] U.S. Cl. ..... 200/52 R; 200/302.2

[58] Field of Search ..... 200/52 R, 61.77, 302.1, 200/302.2, 302.3, 153 F, 153 G, 297, 298, 306, 51.15, 161, 331, 330, 50 B

[56] References Cited

U.S. PATENT DOCUMENTS 3,264,443 8/1966 Farina et al. ..... 200/302.1

4,623,753 11/1986 Feldman et al. ..... 174/50

OTHER PUBLICATIONS

Motorola Part No. 38B43814S01 Blue Print.

*Primary Examiner*—A. D. Pellinen

*Assistant Examiner*—Morris Ginsburg

*Attorney, Agent, or Firm*—Robert J. Crawford

[57] ABSTRACT

A switch arrangement is disclosed which may be used with an enclosed fluid resistant container. A pin-like element is inserted through a wall of the container to actuate a switch contained within the container. Thereafter, the circuit is not easily deactivated. The switch arrangement includes a switch located within the container for activating a particular circuit function. The switch includes a mechanical trigger which is moved to effect the switch activation. A narrow switch actuator, such as a pin, is used for moving the trigger. A slide block is positioned between the trigger and a container wall for impacting the trigger in a single direction. A plug is placed in the wall and has an aperture therethrough for receiving the switch actuator, and the plug also includes a separate labyrinth path therethrough for passing fluid to the outside of the container. The aperture in the plug is structured such that the switch actuator fits slidably in the aperture and substantially seals the aperture. The switch actuator is moved through the aperture to force the slide block to impact the trigger, the switch actuator remains in the aperature to seal the plug, and the labyrinth path in the plug permits fluid to be released from the container.

22 Claims, 8 Drawing Figures

FIG. 1
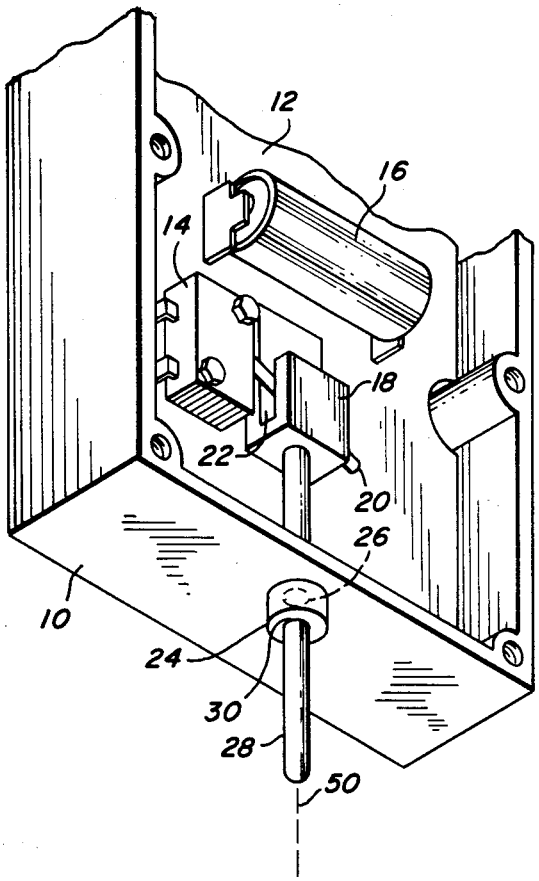
FIG. 2A
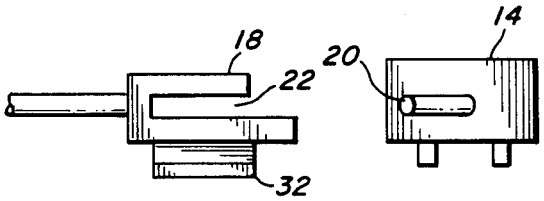
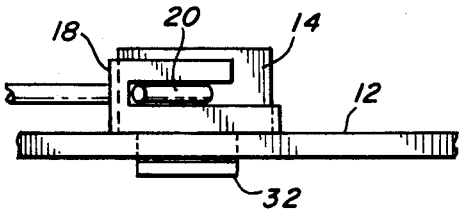
FIG. 2B

SWITCH ACTUATOR SYSTEM

FIELD OF THE INVENTION

The present invention relates generally to a switch actuation device, and, more particularly, to a switch actuation device which is encased and has only limited access.

DESCRIPTION OF THE PRIOR ART

Certain kinds of electronic circuits are required to be protectively encased. For example, electronic circuits installed adjacent automotive engine blocks are often enclosed in a sealed metal casing. The metal casing is used to protect the circuit from harsh environmental conditions, such as high pressure engine washes and even tools which are often dropped or set down around the engine block.

When such electronic circuits are intended for security purposes or intended to provide information to the vehicle's owner regarding the activity of the vehicle, it is desirable to secure the electronic circuit so that once activated, the circuit cannot be disabled. Techniques employed to accomplish this single activation task are known as tamper-proofing techniques.

Commercial and military applications are known which employ such techniques. In some commercial applications, the circuit is activated at installation using a part installation technique. For example, in circuits requiring a battery pack for operation, the battery pack is installed shortly before the encased electronic circuitry is to be used. This is disadvantageous in that this procedure requires additional time and tools, which are usually not in abundance. Further, many part installation techniques require soldering components in place to maintain reliable connections. Unfortunately, soldering is a timely and burdensome task to perform during such installation.

In some military applications, the circuit is activated at installation using a pyrotechnic fuse. Special equipment is used to produce a surge current through the fuse to close a path of a circuit coupled to the fuse. Unfortunately, this special equipment is expensive and not typically found in most industrial or commercial facilities.

Commercially available tamperproof (tamper-resistant) electronic equipment, such as personal computers and cordless telephones, employ holes in their casings which, using a special tool, secure switches and screws from being tampered with by consumers. However, such equipment is often not practical in many instances. For example in the automotive applications described above, a hole in the casing would not permit the circuit to tolerate high pressure washes, since the hole would readily expose the washing fluid to the circuitry.

Accordingly, there is need for an actuation system which can be used for an encased circuit in such harsh environmental conditions, yet overcomes the above mentioned disadvantages.

OBJECTS AND SUMMARY OF THE PRESENT INVENTION

It is a general object of the present invention to provide a switch actuating apparatus which overcomes the above mentioned shortcomings.

It is a further object of the present invention to provide a switch actuating apparatus for an encased circuit which may be exposed to a variety of harsh environments.

It is a further object of the present invention to provide a tamper-resistant switch actuating apparatus for an encased circuit.

the invention may briefly be described in terms of a preferred embodiment involving a switch arrangement on the wall of an enclosed container. The container is the type which is typically used in automotive applications and which will withstand high pressure industrial washes (such as when washing an engine). In a particular application, the container contains a circuit therein for monitoring the automobile activity. Since automobile operators have been known to tamper with such circuits, the embodiment permits the circuit to be activated only once by inserting a pin shaped element into a hole in a wall of the container. Thereafter, the circuit is not easily deactivated through the switch.

The switch arrangement includes a switch located within the container for activating a particular circuit function. The switch includes amechanical trigger which is moved to effect the switch activation. A pin shaped element is used as a switch actuator to move the trigger mechanism. A slide block is positioned between the trigger mechanism and the container wall for impacting the trigger in one direction. A plug is positioned in a hole in the wall of the container. The plug includes an aperture therethrough which is used to receive the switch actuator means, and a labyrinth path is provided through the plug for passing fluid to the outside of the container. The aperture in the plug is structured such that the switch actuator means fits slidably in the aperture and substantially seals the aperture. The switch actuator means is moved through the aperture to force the slide block to impact the trigger, and the labyrinth path in the plug permits fluid to be released from the container, thereby externally effecting a one-time circuit activation while maintaining a fluid resistant container which is capable of releasing fluid contained therein.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawing, in which like reference numerals identify like elements, and wherein:

FIG. 1 is a top view diagram, in accordance with the present invention, of a switch actuation apparatus looking inside container;

FIGS. 2*a* through 2*d* comprise a series of diagrams illustrating the interaction of two components shown in FIG. 1.

DETAILED DESCRIPTION OF THE PREFERRED EMBODIMENT

Figure 2C:
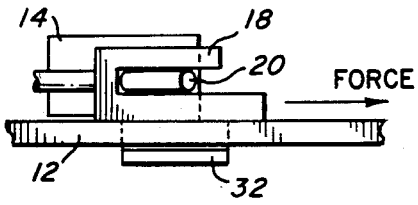

In FIG. 1, a fluid resistant container 10 is shown holding a printed circuit (PC) board 12 therein. The fluid resistance would typically include resistance to such fluids as cleaning fluids, water, oil, etc. The PC board 12 has mounted thereon a switch 14, a battery 16, and a slide block 18.

The switch 14 includes a trigger mechanism 20 for changing the switch position between on and off. For example, the trigger mechanism 20 may be the pole of a single-pole double-throw (SPDT) switch, or, alternatively, trigger mechanism 20 may be a membrane of a membrane switch with a bistable latching circuit coupled thereto. In the latter case, the latching circuit would change from the OFF to the ON state and thereafter remain latched in the ON state.

The slide block 18 includes a slot 22 for capturing the trigger 20. The block 18 also includes a surface wall having a substantially large surface area. This large surface area, as will be discussed below, is used for actuation alignment. The trigger mechanism 20 is depicted with the switch 14 being in the OFF position.

The container 10 includes a wall having a plug 24 mounted into its side. As will be discussed with Figure 3, the plug 24 includes a flexible protruding member extending through a hole 26 in the container wall for holding plug 24 firmly up to the wall of the container. Also to be discussed with FIG. 3, the plug 24 includes a labyrinth path extending through the length of the protruding member.

A pin shaped element 28 is shown in FIG. 1. The element position is shown to depict the element 28 inserted through the hole 26 of the container wall via an aperture 30 in the plug 24. The element 28 is used to actuate the switch 14. As the element 28 is moved into the container via the aperture, one end of the element 28 forces the slide block 18 to move the trigger mechanism 20 into the ON position (state). The element 28 is constructed such that it is slidably movable within the aperture. Additionally, the element 28 is constructed such that it fits within the aperture to seal the aperture, thereby maintaining a substantial fluid resistant container after the switch is actuated.

It should be noted that the end of element 28 that strikes the block 18 is substantially smaller than the surface of the block. This allows relatively simple axial alignment between the hole 26 in the container, the trigger mechanism, and the longitudinal axis 50 of the element 28.

Referring now to FIG. 2*a* through 2*d*, a series of side-view diagrams are shown depicting the interaction between the slide block 18 and the switch 14. In FIG. 2*a*, a lip 32 is shown extending from the slide block 18. A slot (not shown) in the PC board is used to receive the lip 32. This lip is used to laterally support the slide block with respect to the PC board 12. The switch 14 is also depicted with trigger mechanism 20 on the front side of the switch. Assembly of the components requires the slide block 18 being mounted when the switch 14 is mounted in the PC board to properly retain the slide block 18.

In FIG. 2*b*, the switch 14 and the slide block 18 are shown mated on PC board 12. The lip 32 of slide block 18 protrudes through the PC board 12. The illustration in FIG. 2*b* depicts the trigger mechanism 20 in the OFF position.

In FIG. 2*c*, the above structure is illustrated after a force has been applied to the slide block 18. The element 28, from FIG. 1, is used to apply this force to actuate the trigger mechanism 20 into the ON position as discussed above.

Figure 2D:
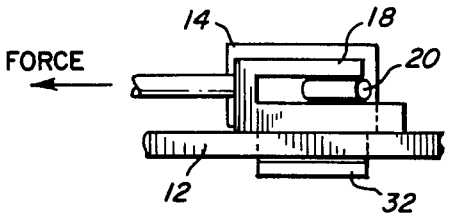

In FIG. 2*d*, the slide block 18 is illustrated in a position away from the ON position of the trigger mechanism 20. One can readily recognize that the switch 14 will not be responsive to any subsequent movement of the slide block 18 in any direction. Since the switch 14 is enclosed in the container 10, and the only access to the switch is via the hole 26 in the container wall, the switch actuation device described in FIGS. 1 and 2 is essentially tamperproof once the switch is activated, i.e., the switch cannot easily be turned off.

This tamperproof feature has been found very useful in high volume manufacturing applications which require such devices built and stocked before installation. In applications which require an on-board battery to supply power to a circuit coupled to the switch, if a battery such as the lithium cell type is used, the device may be manufactured with the battery and stored in inventory for up to 10 years before being activated. Installation at that time requires only that element 18 be moved further inside the aperture to actuate the trigger mechanism and to cause the battery to power the circuit coupled thereto.

Figure 3A:
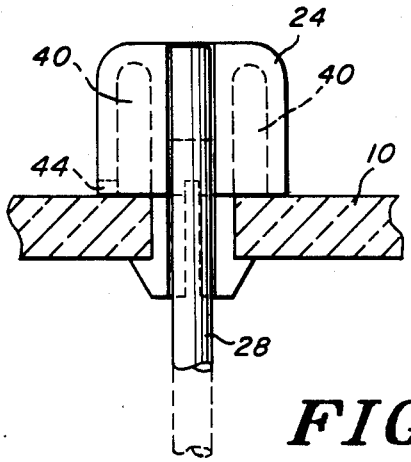
FIGS. 3*a* through 3*c* depict different views of a plug, in accordance with one aspect of the present invention, which is originally shown in FIG. 1.
Figure 3B:
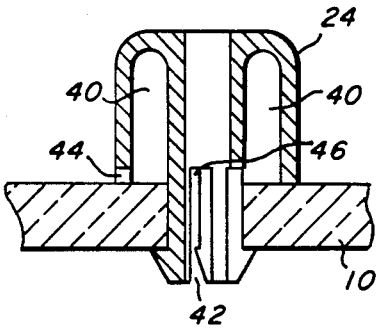
Figure 3C:
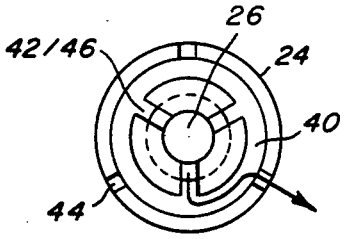

An additional feature of the device is the labyrinth path through the plug 24 mentioned above. If the container is mounted such that the container wall holding the plug 24 is on the under side, with respect to gravity, then the labyrinth path can be used to release fluids from the container which may have entered via condensation or through faulty container seals. FIGS. 3*a* through 3*c* illustrate this labyrinth path in the plug 24.

In FIG. 3*a*, the plug 24 is illustrated being mounted on a wall of the container 10 with the inside of the container being depicted at the underside of the container wall. Inserted in the aperture of the plug is the pin shaped element 28. Again, the element 28 is shown in two positions. The initial position of the element 28 is shown in dotted lines, while the second position, after being moved into the container to impact the slide block, is shown in solid line form.

In FIG. 3*b*, the plug 24 is illustrated without the pin shaped element 28, but a side view of the labyrinth path is provided. The path begins through an opening 42 along the wall of the protruding member of the plug, i.e. the portion of the plug protruding into the container wall. The opening extends just over the top of the container wall (depicted by 46) and into another opening 40 within the plug. A third plug opening 44 is provided just above the container wall at the outer perimeter of the plug.

FIG. 3*c* provides a top view of the plug 24 and further illustrates the labyrinth path as indicated by the arrow.

A preferred way of manufacturing the plug 24 is to mold the plug to the element 28 and to install the switch actuation apparatus in this position. The element 28 may then be broken from the mold and be punched into the plug to lock the plug into the container wall. To activate the switch, the element is further punched into the aperture.

While the invention has been particularly shown and described with reference to a preferred embodiment, it will be understood by those skilled the art that various other modifications and changes may be made to the present invention described above without departing from the spirit and scope thereof.

What is claimed is:

1. A switch actuation apparatus, comprising:

a substantially fluid resistant container having at least one container wall;

switch means, located within the container, for activating a circuit;

switch actuator means adapted for triggering the switch means in response to movement of said switch actuator means;

a plug having an aperture therethrough for receiving the switch actuator means, and having a labyrinth path therethrough for passing fluid, said switch actuator means fitting movably in the aperture; and said container wall having a hole therethrough for receiving the plug, wherein the switch actuator means triggers the switch means as it is moved through the aperture, and wherein the labyrinth path in the plug permits fluid to be released from the container.

2. The switch actuation apparatus, according to claim 1, wherein the switch actuator means is positioned in and substantially seals the aperture.

3. The switch actuation apparatus, according to claim 1, wherein said labyrinth path is separate from said aperture.

4. The switch actuation apparatus, according to claim 3, wherein said labyrinth path is located radially peripheral to said aperture.

5. The switch actuation apparatus, according to claim 1, wherein said actuator means comprises a pin shaped element having a longitudinal axis adaptive for passing through said aperture.

6. The switch actuation apparatus, according to claim 1 wherein said actuator means is axially movable with respect to said aperture and said switch means.

7. The switch actuation apparatus, according to claim 1, wherein the plug includes a protruding member extending from the plug and flexibly adaptable for fitting in the hole of the container wall.

8. The switch actuation apparatus, according to claim 7, wherein the labyrinth path is partially aligned with said protruding member.

9. A tamper-resistant switch actuation apparatus, comprising:

a container having at least one container wall;

switch means located within the container for activating a circuit function and having a trigger mechanism which is moved to implement the activation;

switch actuator means having an end portion adaptable for entry into said container and adapted for effecting trigger mechanism movement;

a block, positioned in the container between the trigger mechanism and the container wall, for impacting the trigger mechanism in one direction such that the switch means does not respond to subsequent movements of said block; and said container wall having a hole therethrough for receiving the switch actuator means, wherein the switch actuator means is movable in the hole and actuate the switch means via said end portion contacting and moving said block as the switch actuator means is moved through the hole in the one direction.

10. The tamper-resistant switch actuation apparatus, according to claim 9, wherein said block has a wall with a surface area which is substantially larger than the end of the switch actuator means to ensure proper alignment as the switch actuator means contacts the block.

11. The tamper-resistant switch actuation apparatus, according to claim 9, wherein said actuator means comprises a pin shaped element having a longitudinal axis adaptive for passing through said hole.

12. The tamper-resistant switch actuation apparatus, according to claim 9, wherein said actuator means is axially movable with respect to said hole and said switch means.

13. The tamper-resistant switch actuation apparatus, according to claim 9, wherein said trigger mechanism has two stable positions, one position at least initially corresponding to circuit activation and the other position corresponding to circuit nonactivation.

14. The tamper-resistant switch actuation apparatus, according to claim 9, wherein said switch means and said block are mounted on a PC board located within the container.

15. The tamper-resistant switch actuation apparatus, according to claim 14, wherein said block includes a lip extending into the PC board.

16. A tamper-resistant switch actuation apparatus, comprising:

a substantially fluid resistant container having at least one container wall;

switch means located within the container for activating a circuit function and having a trigger mechanism which is moved to implement the activation;

switch actuator means having an end portion adaptable for entry into said container and adapted for effecting trigger mechanism movement;

a block, positioned in the container between the trigger mechanism and the container wall, for impacting the trigger mechanism in one direction such that the switch means does not respond to subsequent movements of said block; and a plug having an aperture therethrough for receiving the switch actuator means, said switch actuator means fitting movably in the aperture; and said container wall having a hole therethrough for receiving the plug, wherein the switch actuator means is slidably movable in the aperture and actuates the switch means via the block as the switch actuator means is moved through the hole in the one direction.

17. The tamper-resistant switch actuation apparatus, according to claim 16, wherein the plug substantially seals the aperture.

18. The tamper-resistant switch actuation apparatus, according to claim 16, wherein said actuator means comprises a pin shaped element having a longitudinal axis adaptive for passing through said aperture.

19. The tamper-resistant switch actuation apparatus, according to claim 16, wherein said actuator means is axially movable with respect to said aperture and said switch means.

20. The tamper-resistant switch actuation apparatus, according to claim 16, wherein the plug includes a protruding member axially extending from the plug with respect to the aperture and flexibly adaptable for fitting in the container wall.

21. The tamper-resistant switch actuation apparatus, according to claim 16, wherein said block has a wall with a surface area which is substantially larger than the end of the switch actuator means to ensure proper alignment as the switch actuator means contacts the block.

22. The tamper-resistant switch actuation apparatus, according to claim 16, wherein the actuation of said switch means activates a power supply.

* * * * *